United States Patent [19]

Okubo

[11] 4,203,525

[45] May 20, 1980

[54] VAULTING BOX

[76] Inventor: Yoshikazu Okubo, 837-1 Hachigasaki, Matsudo-shi, Chiba-ken, Japan

[21] Appl. No.: 811,436

[22] Filed: Jun. 29, 1977

[30] Foreign Application Priority Data

Dec. 9, 1976 [JP] Japan ..... 51/164101[U]

[51] Int. Cl.[2] ..... B65D 21/02; A63B 5/12

[52] U.S. Cl. ..... 220/4 C; 46/25; 220/8; 206/501; 206/514; 272/64

[58] Field of Search ..... 220/4 C, 4 D, 8; 206/501, 505, 514; 272/64; 46/25

[56] References Cited

U.S. PATENT DOCUMENTS

| | | | |
|---|---|---|---|
| 504,445 | 9/1893 | Dare | 220/8 |
| 1,239,307 | 9/1917 | Schmid | 220/345 |
| 2,278,894 | 4/1942 | Paulson | 46/25 |

FOREIGN PATENT DOCUMENTS

| | | | |
|---|---|---|---|
| 212047 | 3/1924 | United Kingdom | 220/8 |
| 538563 | 8/1941 | United Kingdom | 272/64 |
| 633460 | 12/1949 | United Kingdom | 272/64 |

*Primary Examiner*—George E. Lowrance

[57] ABSTRACT

A plurality of frame members. Each of the frame members have a truncated pyramid shape of successively reduced size. The members are able in one condition, to be stacked one upon the other to form an enlarged truncated pyramid shape box and in a second condition to be nested one within the other. A cover for the uppermost one of the members and a plate insertable in a slot in a wall of the frame member to partition the box are provided.

11 Claims, 4 Drawing Figures

VAULTING BOX

BACKGROUND OF THE INVENTION

The present invention relates to a box structure and in particular to a structure made of a plurality of frame members capable in one condition of being stacked to form the box and in another position to be nested in telescopic fashion for storage and/or transportation.

It is a primary object of the present invention to provide a multi-purpose box-like structure which may be easily assembled as well as easily disassembled and stored.

It is a particular object of the present invention to provide a vaulting box which may be easily compacted, thereby achieving a substantial decrease in transportion, handling and storage costs.

It is a further object to provide a box structure capable of use for storage of various objects.

These objects as well as other together with numerous advantages will be apparent from the following disclosure.

SUMMARY OF THE INVENTION

According to the present invention, a box-like structure is provided of a plurality of frame members, each of which have a truncated pyramid shape of successively reduced size. The frame members are, in one condition stackable, one upon the other to form an enlarged truncated pyramid shape box and in a second condition nestable telescopically one within the other. The upper most one of the members is provided with a cover, preferably hinged while the remaining ones of the members have at least one horizontal slot in a wall thereof and a partitioning plate insertable therein to divide the box, vertically.

Full details of the present invention follow herein and are illustrated in the accompanying drawings.

DESCRIPTION OF THE INVENTION

Figure 1:
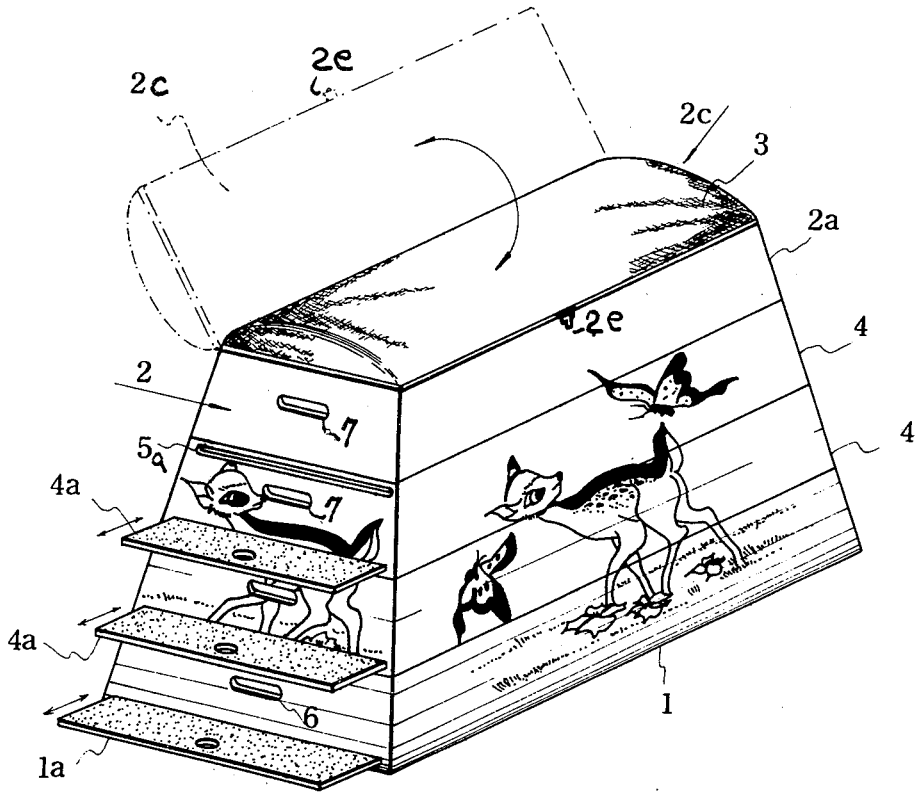
FIG. 1 is a perspective view showing a plurality of frame members of the present invention assembled into a vaulting box.
Figure 2:
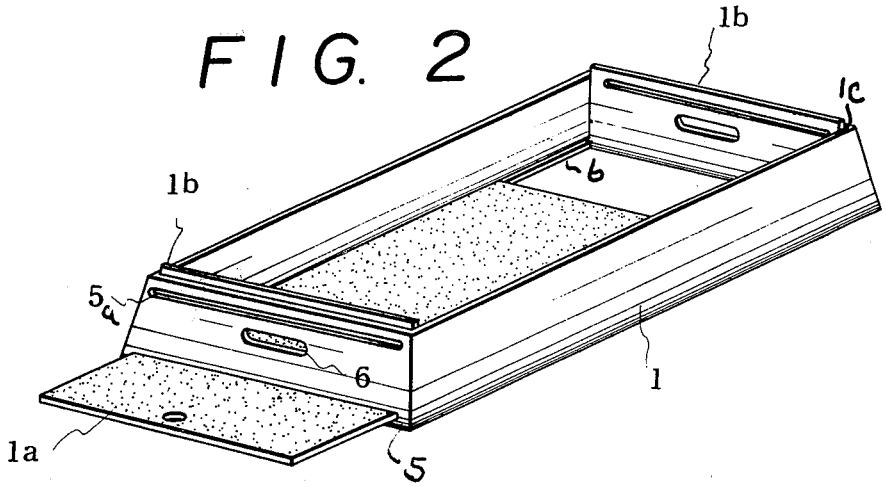
FIG. 2 is a perspective view showing one frame member employed in forming the vaulting box of FIG. 1.
Figure 3:
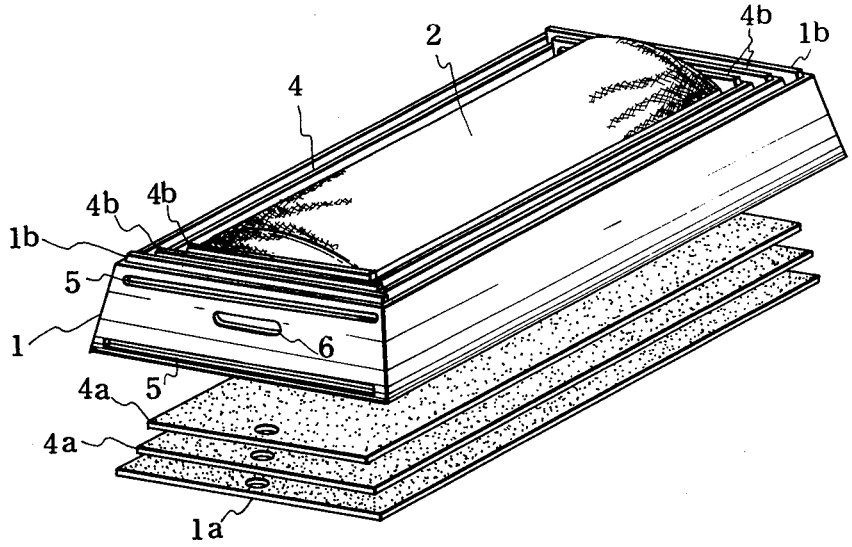
FIG. 3 is a perspective view showing the frame members in nested condition.

The present invention as shown in the drawings illustrates the assembly of a vault box which comprises basically a lower pyramid shaped frame member 1 and an upper pyramid shaped frame member 2. If desired, one or more intermediate frame members 4 of similar truncated pyramid shape may also be provided. The frame members are adapted to be stacked one on the other, each successive frame being of slightly reduced scale so that a truncated pyramidal vault box may be assembled with all the frames employed and of an overall dimension that successive frame members are capable of nesting one within the other, as will be hereinafter described.

The bottom frame member 1 is provided with a bottom closure plate 1*a* which is adapted to slide through a slot 5 formed in one end wall and through longitudinal grooves 6 formed in the side walls. Integrally formed on the interior of each side wall is an upwardly extending flange 1*b* providing a positioning shoulder at each end of the frame, coplanar with the upper edge of the side walls to form a continuous perimeter edge 1*c*.

Figure 4:
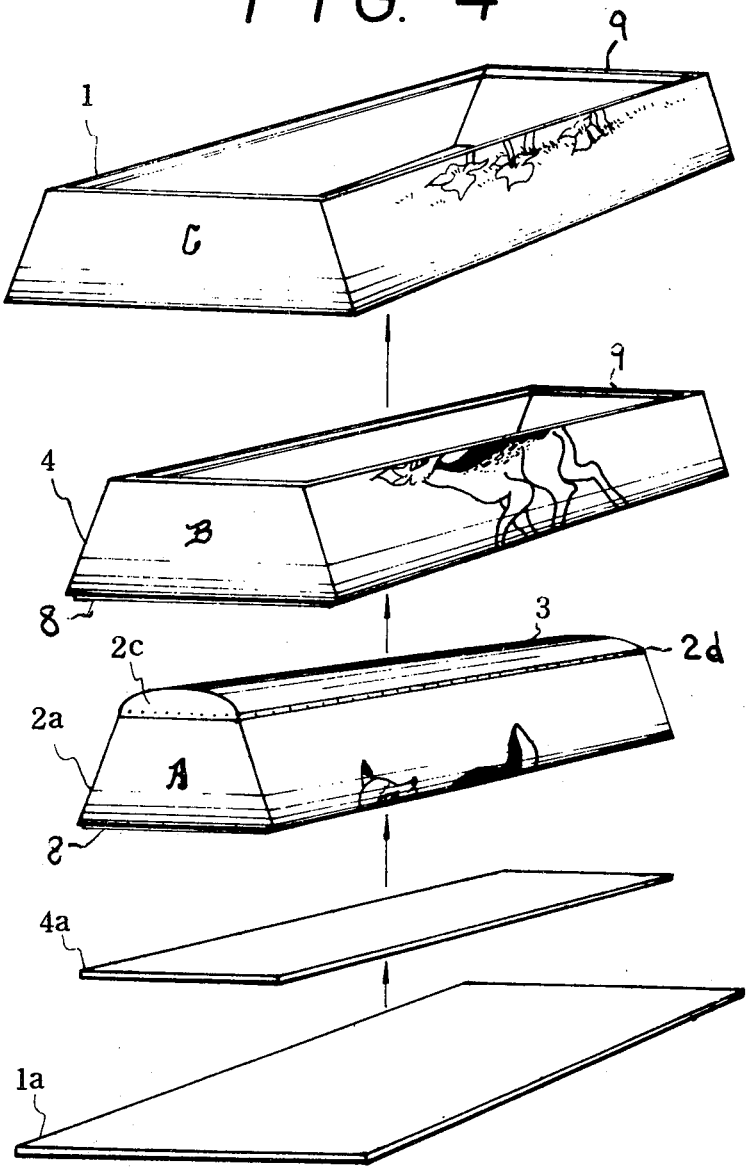
FIG. 4 is an exploded perspective view showing assembly of the members into the nested state of FIG. 3.

The upper frame 2, when used alone with the lower frame member has a bottom edge conforming to the perimeter of the top edge 1*c* of the lower frame 1 so as to seat thereon, being easily positioned and held in place by the upward extending flange 1*b*. The upper frame member 2 is provided with a cover 2*c* on which is secured a padded cushion 3. The cover 2*c* may be pivotally secured to the upper frame 2 by a hinge 2*d* (as seen in FIG. 4) so that it may be opened (dotted lines in FIG. 1) to provide access to the interior of the vault box. A latch 2*e* may be provided to fasten the cover 2*c* in place. On the other hand, the cover 2*c* may be secured to the frame so as to be non-movable.

The intermediate frames 4, when employed, are similarly constructed to the bottom member 1 having an upwardly extending flange 4*b* at each end and continuous upper and lower perimetal edges so that they can be stacked, in secure assembly. Each of the intermediate members is provided with a slot 5, capable of receiving a slidable plate 4*a*, similar to that of the bottom plate 1*a*.

In addition each of the bottom and intermediate frames are provided with a second slot 5*a* in one end wall through which the slidable plate 1*a* or 4*a* (or additional) plates may be inserted.

The end wall of each frame is provided with a slot 7 permitting entry of the hand so that the plates 1*a* and 4*a* may be easily shifted or removed by mere finger touch. In this manner these plates enable the interior of the vault box to be divided into several sections, and when slightly withdrawn to extend outwardly from the end walls provide ledges upon which items, such as play things, may be placed or steps for children to climb. Each plate may be provided with a finger hole to facilitate grasping.

It will be noted that in place of the abovementioned upward projecting edges, 4*b*, a procedure for securing engagement of the frames corresponding thereto may be employed, in which for example, a downwardly projecting edge 28 is provided at the lower perimetal edge of the upper frame 2, and each of the intermediate frames, as shown in FIG. 4. The downwardly projecting edges 28 may be formed about the perimeter of the frame in the wall of the frame and a corresponding recess or rabbit 9 may be formed along the upper edge. In this manner, cooperating flange and recesses will prevent dislodgement of the stacked members.

In accordance with the desired use, the vaulting box may include antiskids feet or other means to prevent movement along the floor, the display on the outer surfaces of the frames, figures, alphabets and other indicia for enjoyment, study or the like.

It will be further noted that the abovementioned bottom plate 1*a*, 4*a* may serve, when removed, as a blackboard or other educational tool.

It will be seen that with the construction described above, when the bottom plate and the upper plate, 1*a*,4*a* are removed, the frames, each successively reduced in scale, may be nested into each other thereby providing a compact arrangement for storage and/or transportation. This, as will be seen from FIG. 4, proceeds first by removing the top most frame (label A) thereafter each successive intermediate frame (label B) and lastly the bottom frame (label C).

As will be seen, the present invention provides a box which may be easily assembled or disassembled into compacted form when not in use thereby achieving a great decrease in transportation cost and handling costs, and permits easy storage of the box in a nest form by the end user.

Amongst the multi-purposes attained by the box structure of the present invention is its effective use, for example, as a substitute for a step or high chair, a filing and holding cabinet, a storage box, or a means of play such as in children's playing house, train, and the like.

While the present invention is illustrated as forming a vaulting box it is apparent that it may be employed to form other structures, of varying height, width, shape and function. Accordingly, the present disclosure is to be taken as illustrative only and not limiting of the scope of the invention.

What is claimed:

1. A box-like structure comprising a bottom frame member, a top frame member, and at least one intermediate member, each of said frame members having, a plurality of sides inclined inwardly to the vertical defining a truncated pyramid shape of successively reduced size in height, length and width, the upper edge of each frame members having a pyramidal dimension conforming to the pyramidal dimension of the lower edge of the next successive frame member of reduced size enabling said frame members, in one condition, to be stacked successively edge to edge from bottom to top one upon the other to form an enlarged truncated pyramid shape box and in a second condition to be nested successively from top to bottom completely one within the other, the top frame having a cover, and the bottom frame member having a slot in a wall thereof and a closure plate insertable therein to form a bottom wall for retaining the frame members nested therein.

2. The box according to claim 1, wherein at least one intermediate member has a slot horizontally directed along the lower edge of one end wall thereof and is provided with a partitioning plate insertable therein.

3. The box according to claim 2 including a second slot extending horizontally along the upper edge of said one side wall of the respective frame member.

4. The box according to claim 1, wherein said cover on the uppermost frame member is removable.

5. The box according to claim 1 wherein said cover on the uppermost frame member is hingedly secured to said frame to be pivotal into open and closed positions.

6. The box according to claim 1 including a hole formed in the wall of each of said frames permitting entry of a hand therein for manipulation of said plate.

7. The box according to claim 1, wherein the abutting edges of said frame members are formed with cooperated extending flanges and recesses to enable securement of said frame members in stacked condition.

8. The box according to claim 7, wherein the upper edges of said frame members is provided with an upwardly extending flange, and the corresponding lower edge with a recess to receive said flange.

9. The box according to claim 7, wherein the lower edges of said frame members is provided with a downwardly projecting flange and upper edge of said frame is provided with a recess for receiving the same.

10. The box according to claim 1, wherein the upper edge of said frame member is provided with an upwardly directed flange, on the interior surface of the opposite ends thereof, adapted to extend within the adjacent frame member to secure the same.

11. The box according to claim 1, including slot means formed on the interior surfaces of the remaining walls of the bottom frame member slidably receiving said closure plate.

* * * * *